US006729050B2

(12) United States Patent
Whitten et al.

(10) Patent No.: US 6,729,050 B2
(45) Date of Patent: May 4, 2004

(54) CONTROL OF EXCAVATION APPARATUS

(75) Inventors: Dean Whitten, Pella, IA (US); Dan Hawks, Pella, IA (US); Mike Vander Hart, Pella, IA (US); Mark Cooper, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 10/227,813

(22) Filed: Aug. 27, 2002

(65) Prior Publication Data

US 2003/0041485 A1 Mar. 6, 2003

Related U.S. Application Data

(60) Provisional application No. 60/316,590, filed on Aug. 31, 2001.

(51) Int. Cl.[7] ..... E02F 5/08; E02F 3/10

(52) U.S. Cl. ..... 37/96; 37/464

(58) Field of Search ..... 37/96, 97, 95, 37/94, 91, 305, 304, 306, 351, 355, 357, 359, 360, 361, 362, 107, 104, 105, 190, 463, 464, 462; 171/16; 404/91, 96, 104

(56) References Cited

U.S. PATENT DOCUMENTS

| | | | | |
|---|---|---|---|---|
| 3,690,023 A | 9/1972 | Peterson | ..... | 37/90 |
| 5,209,001 A | 5/1993 | Gilbert | ..... | 37/87 |
| 5,315,770 A | 5/1994 | Campbell | ..... | 37/96 |
| 5,671,554 A | 9/1997 | Geelhoed | ..... | 37/348 |

FOREIGN PATENT DOCUMENTS

| | | |
|---|---|---|
| DE | 18 04 000 | 5/1971 |
| DE | 32 07 104 | 9/1983 |
| DE | 42 43 696 | 2/1994 |
| GB | 910 818 | 11/1962 |
| JP | 58 007038 | 4/1983 |

*Primary Examiner*—Christopher J. Novosad
(74) *Attorney, Agent, or Firm*—Sturm & Fix LLP

(57) ABSTRACT

A method and apparatus for controlling an excavator having a frame, engine, ground supports and an excavation boom with an excavating drum. The method includes fixing the orientation of the boom relative to gravity to approximately control the shape of an excavated ground plane.

14 Claims, 12 Drawing Sheets

CONTROL OF EXCAVATION APPARATUS

CROSS-REFERENCE TO RELATED APPLICATIONS

This application contains disclosure from and claims the benefit under Title 35, United States Code, §119(*e*) of the following U.S. Provisional Application: U.S. Provisional Application Ser. No. 60/316,590 filed Aug. 31, 2001, entitled IMPROVED EXCAVATION APPARATUS.

STATEMENT REGARDING FEDERALLY SPONSORED RESEARCH OR DEVELOPMENT

Not Applicable

BACKGROUND OF THE INVENTION

1. Field of the Invention

One aspect of the present invention relates generally to the control of an excavator for breaking-up hard soils, rock, or concrete into manageable sized pieces for subsequent handling or processing. The excavator acts on an existing ground surface, acting on a layer of material to define a new ground surface that is below the original. The process is used for road construction and mining. This aspect of the present invention relates more particularly to the arrangement of sensors and methods of utilizing sensors, which allows control of the depth of cut, orientation of the resulting new ground surface, and location of the new ground surface.

2. Description of the Related Art

Road Bed Preparation

In the preparation of a road bed one critical function is to establish the proper lateral grade. In most cases the desired lateral grade is level, with the exception of regions where the road curves and a banking effect is desirable. In both cases, when constructing new roads the grade of the native topography will typically need to be modified to achieve the desired grade. Certain ground conditions prohibit excavation in a manner wherein very fine adjustments can be made. These include conditions of rock and very hard soils. In these conditions the surface is typically excavated below the desired level, and finer more manageable materials backfilled to bring the grade to the desired level.

The process of replacing a damaged road surface often begins with the step of removing the existing road surface. The current methods of removing existing road surfaces of concrete are complicated by the existence of steel reinforcing rod that is integral to the concrete road surface. Current techniques of breaking up the road surfaces are slow and labor intensive often including the use of some form of impact wherein the existing road surface is struck from the above and broken into smaller pieces, and at the same time separating the reinforcing rod.

Mining

Many types of non-metallic rock are mined from shallow open-pit mines called quarries. The process is known as quarrying, open cast or surface mining. One quarrying technique involves drilling and blasting to break the rock. When usable rock is found, the surface is cleared to expose the desired rock. The area being mined is then drilled and blasted, a large number of low-powered explosives detonated at the same time to shatter the rock. The drillings are controlled to a depth to stay within the strata of desirable rock, as may have been determined by preliminary exploratory drillings. A single blast produces as much as 20,000 tons of broken stone. The broken stone is then loaded by handling equipment and transported to additional equipment to be crushed into smaller pieces and separated into uniform classes by screening methods. During that time the broken stone is exposed to the elements and some may be affected by weathering damage. This process is relatively labor intensive, produces work-in-process subject to damage. New techniques are recently being developed.

One such technique of quarrying is labeled as percussive mining in U.S. Pat. No. 5,338,102. In this reference a percussive mining machine is utilized to successively strike or impact the material with a cutting tool. In this case the cutting tools are mounted to a rotating drum that is propelled on a mining machine. The mining machine illustrated includes components representative of many machines which have recently been developed for this application. The machines typically include some form of ground drive, supporting frame for the drum, power unit to provide power to rotate the drum, a conveyance mechanism and some form of height control, to control the position of the drum. Examples of other machines, built specifically for this application, can be found in U.S. Pat. Nos. 5,092,659; 5,577,808; and 5,730,501. These machines are highly specialized, with limited additional use.

An example of a more versatile machine, built on a more generic platform, can be found in U.S. Pat. No. 4,755,001. This reference discloses an excavating machine that consists of a digging head mounted to an elongated digging member, both mounted to a main frame. The main frame resembles machines currently known as track trenchers.

Track trenchers, as is illustrated in FIG. 1, were originally designed for forming trenches for the installation of drainage lines or other utilities in open trench installations. The basic components of a Track Trencher 10 include:

1) a main frame 30;
2) a set of ground engaging track assemblies 20 which are fixedly supported by the main frame 30 in a manner that allows the drive sprocket 22 to be driven to propel the machine along the ground;
3) a power unit 40 typically a diesel engine; and
4) an excavation boom assembly 50 which is relatively narrow, as compared to its length, as most trenches are much deeper than they are wide.

The power unit 40 provides power to the driven/drive components of the machine. This is typically comprised of a diesel engine and a hydraulic system. The hydraulic power is transferred to various actuators mounted on the machine to perform the desired operations including:

1) a hydraulic motor 24 mounted onto the track drive frame that drives the track drive sprockets 22;
2) a hydraulic motor 52 mounted on frame 30 that supports and drives a sprocket which drives the excavation chain 54 that is supported on an idler sprocket 56 which is supported by the boom frame 51; and
3) a hydraulic system that includes lift cylinders 62 to raise and lower the excavation assembly In trenching the primary parameter that needs to be controlled is the depth of the trench. The machine provides this control by controlling the position of the boom relative to the ground engaging tracks, typically allowing the boom to pivot around an axis defined by the machine frame. This pivot is designed robustly to handle the severe loading, particularly experienced when excavating rock. Typically the only movement of the boom relative to the frame is provided by pivoting about this axis.

Controlling the height of each ground drive unit, track, independently allows the frame to be kept level and thus the orientation of the resulting trench can also be controlled. However, this technique of orientation is not ideal in that the entire machine is being controlled resulting in higher power requirements and reduced responsiveness.

BRIEF SUMMARY OF THE INVENTION

The present invention relates generally to an excavation machine having a frame and an excavation boom. The excavation boom is pivotally mounted to the frame at a boom mount pivot axis to allow control of the excavation depth. The excavation boom includes an excavating chain that drives an excavating drum, both rotating about an excavation axis. The boom further includes an integral pivot that allows the position and/or orientation of the excavating drum to be adjusted, relative to the frame and the boom mount pivot axis.

Road Bed Preparation

The present invention is particularly useful for providing a control system wherein the initial excavation for a road bed can be accomplished in a manner that is accurate and precise allowing the depth of excavation and the related amount of backfill material necessary to be reduced to a minimum.

Mining

The apparatus of the present invention is particularly useful for certain types of mining operations with its ability to control the excavating drum to optimize the orientation of the ground surface and the excavating parameters.

DETAILED DESCRIPTION OF THE INVENTION

Figure 1:
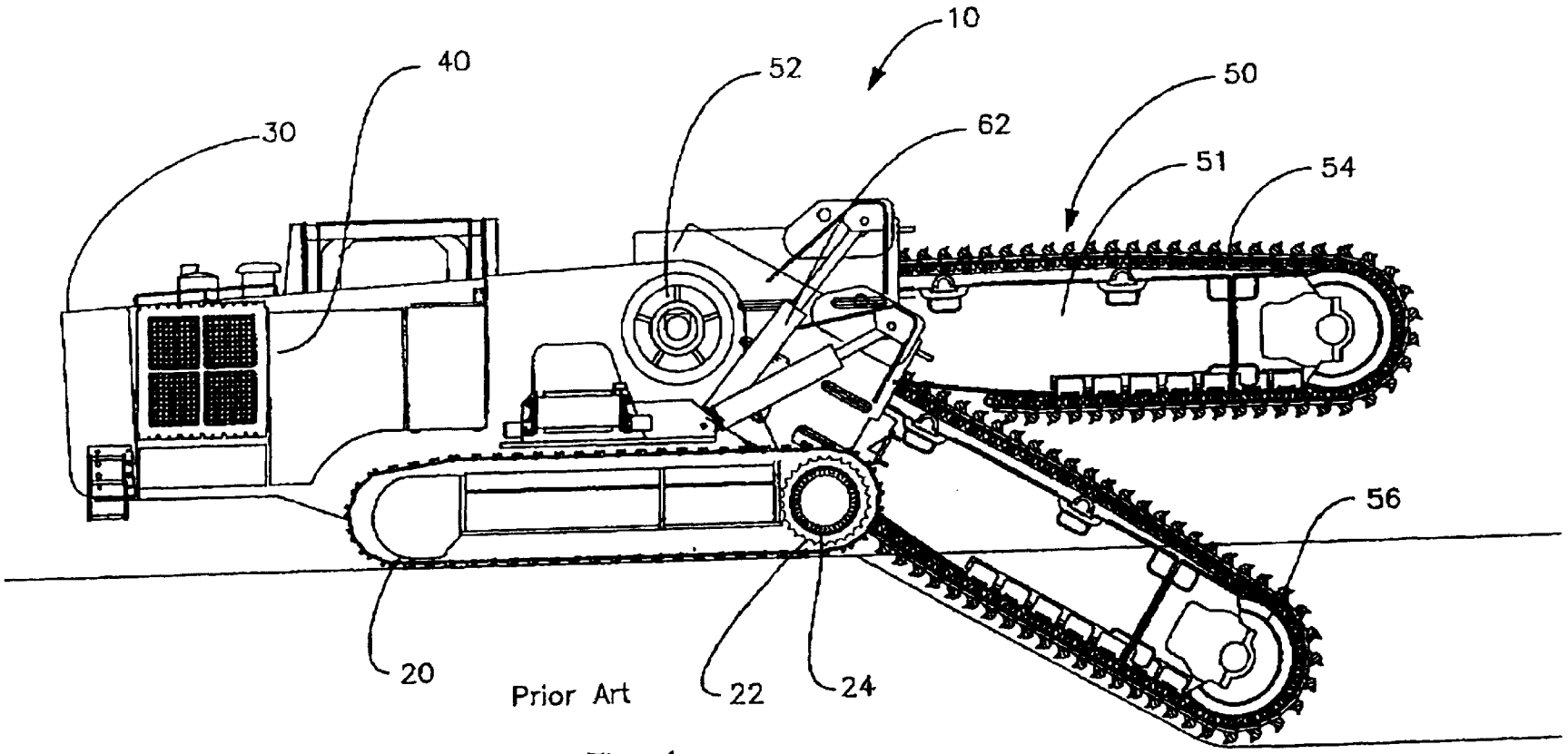
Prior Art Fig 1
FIG. 1 is a side view of the prior art track trencher with a standard boom.
Figure 2:
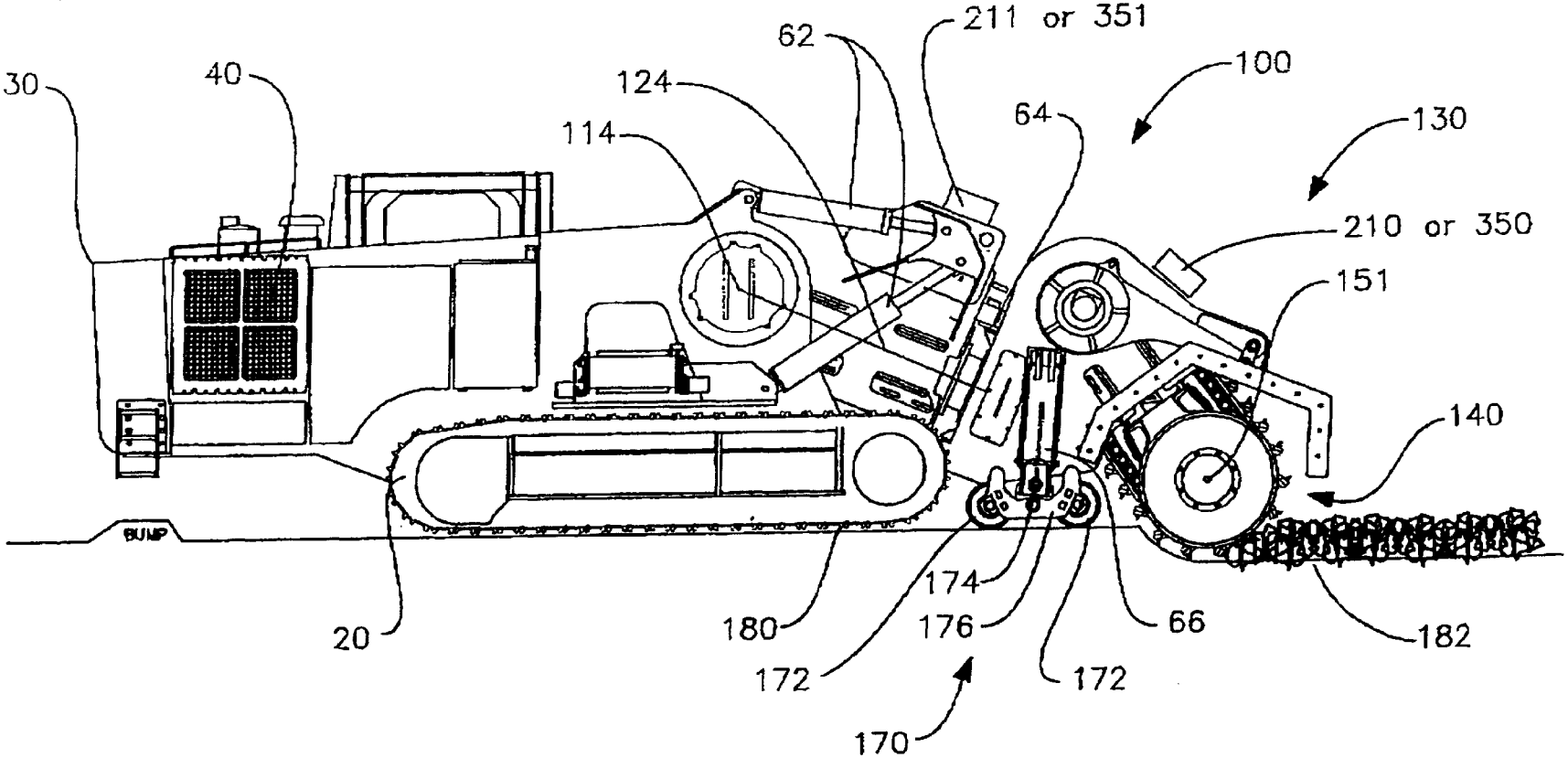
FIG. 2 is a side view of a track trencher with an alternative boom.
Figure 3:
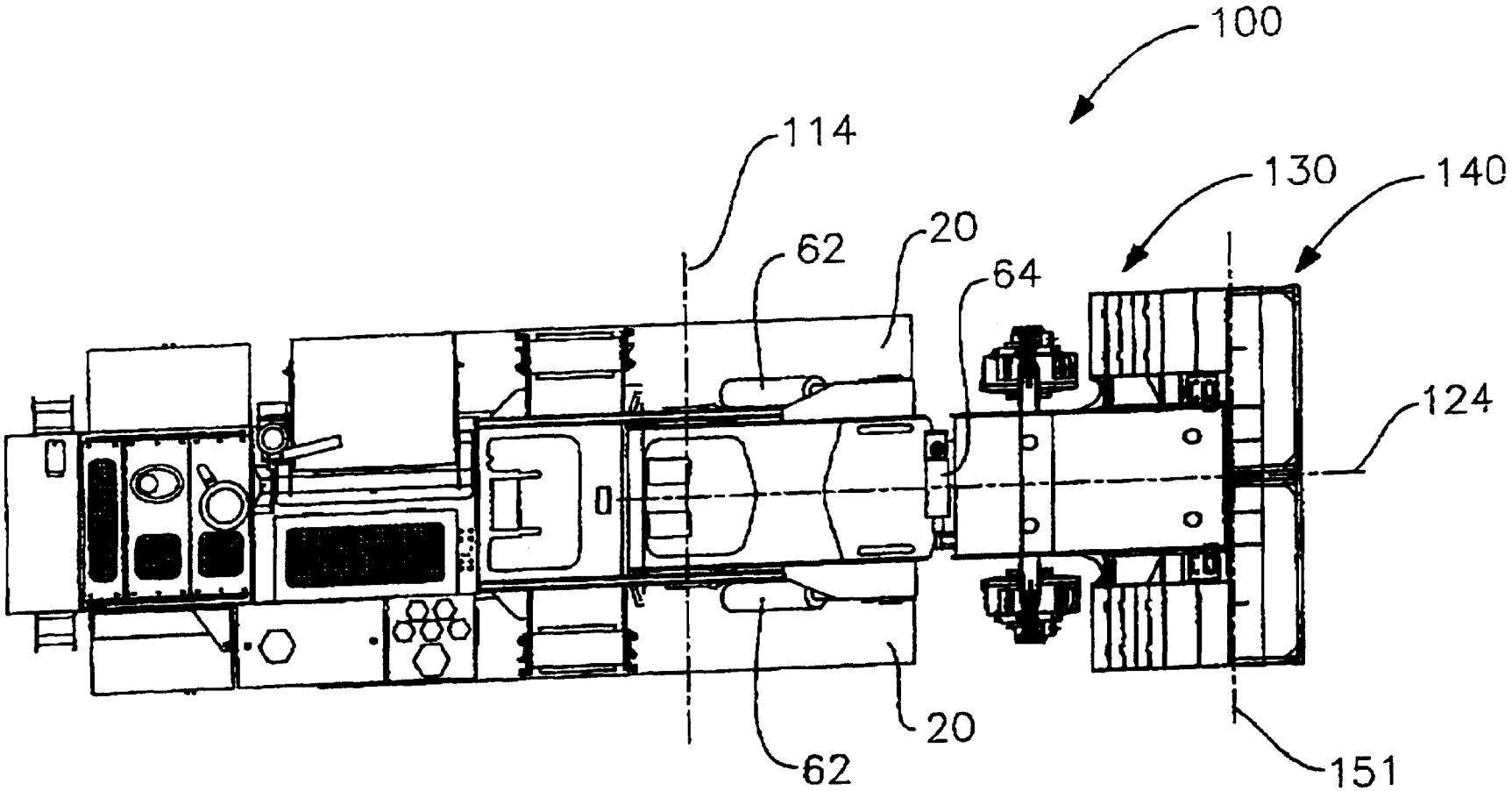
FIG. 3 is a top view of a track trencher with an alternative boom.

Referring now to the drawings wherein like reference numerals designate identical or corresponding parts throughout the several views, FIGS. 2 and 3 illustrate a track trencher with an alternative excavation boom 100, as disclosed in co-pending U.S. patent application Ser. No. 10/227,838 Aug. 27, 2002. The track trencher comprises track assemblies 20, frame 30, power unit 40, and excavating boom 100 including head unit 130, which supports excavation assembly 140. The orientation of the base machine is defined by the existing ground surface 180. The areas contacted by the two track assemblies 20 will define the effective ground plane 180, oriented at an angle relative to gravity, the effective grade.

The location and orientation of the excavation assembly 140 will define the new ground surface 182. This location and orientation is controlled by several elements. The position of the boom 100 relative to frame 30 is controlled with lift cylinders 62, which effectively rotate boom 100 about axis 114, defined by frame 30 as parallel to the existing ground surface 180, to effectively control the excavation depth, relative to the track assemblies 20.

The orientation of the excavation assembly 140, relative to the frame 30, is controlled with tilt cylinders 64, which rotate the head unit 130 about swivel axis 124. Swivel axis 124, in this preferred embodiment, is perpendicular to axis 114, allowing the orientation of the head unit 130 and excavation assembly 140 to be modified relative to axis 114 and the ground plane 180. Alternatively, a swivel axis, not shown, could be merely parallel with swivel axis 124.

The excavation assembly 140 is designed to be in contact with the ground in order to excavate a certain depth, the difference between the existing ground surface 180 and the new ground surface 182. The amount of force necessary to hold the excavation assembly 140 in the position to maintain a consistent excavation depth, excavation force, depends greatly on the type of material being excavated. In some conditions the weight of the head unit 130 is sufficient, and the excavation force is equal to the weight of the head unit 130. At other times additional force is required, and the lift cylinders 62 are utilized to effectively transfer some of the weight of the base machine to the excavation assembly 140.

As shown in FIG. 2, the positioning assembly 170 also affects the loading and position of the excavation assembly 140 relative to the existing ground plane 180. Stabilizer cylinders 66 extend from the frame of head unit 130 to bogey wheels 172 which may or may not be in contact with existing ground surface 180. If in contact they carry at least a portion of the excavation load.

Figure 2A:
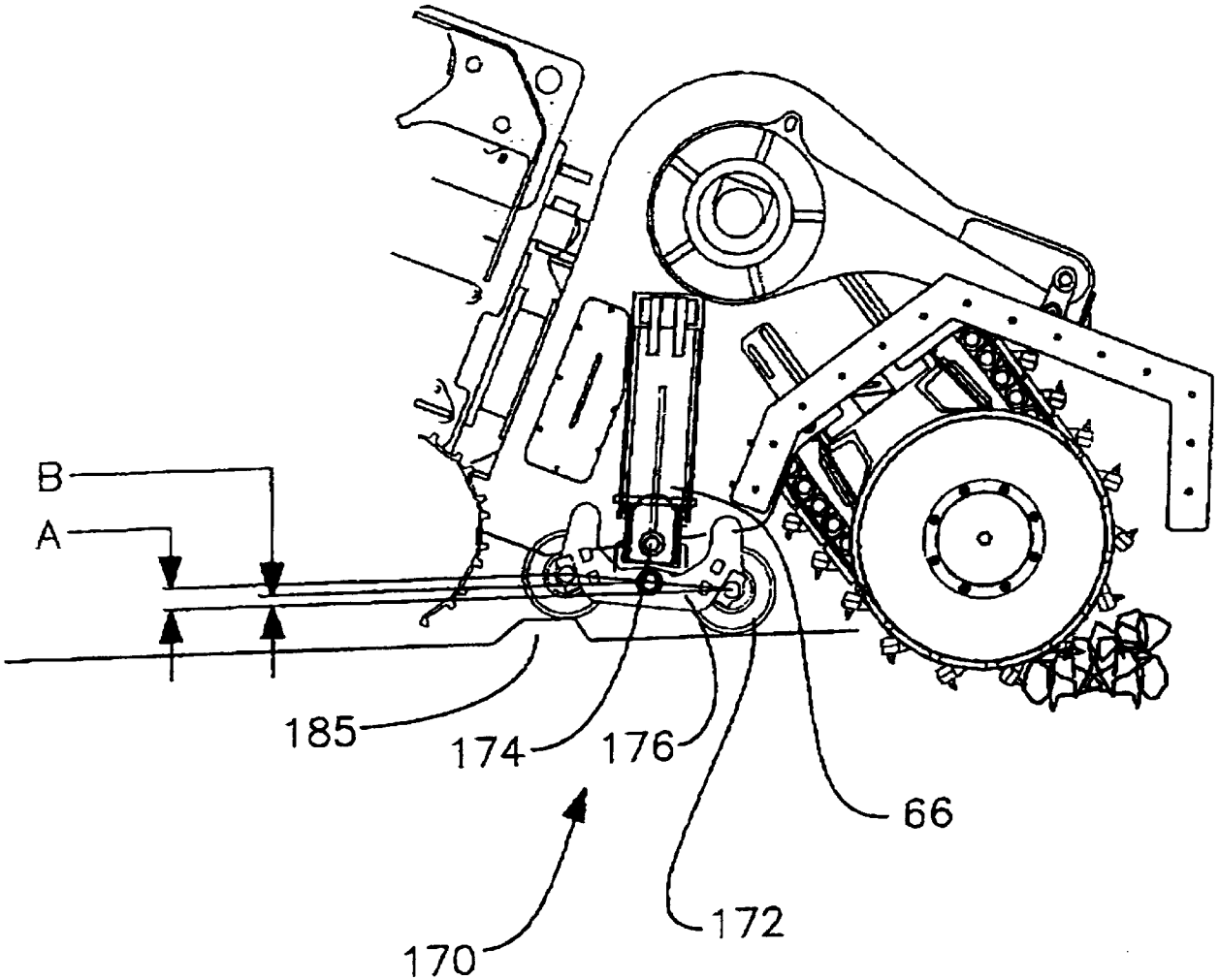
FIG. 2*a* is an enlarged partial side view of a track like that shown in FIG. 2.

The positioning assembly 170 (FIGS. 2 and 2*a*) is comprised of a stabilizer frame 176 which connects to the stabilizer cylinder 66 at a pivot point 174. The stabilizer frame 176 provides mounts for the bogey wheels 172. The bogey wheel and frame 176 are free to rotate around the pivot point 174. By freely rotating the pivot point 174 does not need to move as much when encountering relatively small surface irregularities. As illustrated in FIG. 2*a*, with certain irregularities, such as bump 185, the travel of pivot 174 will be approximately ½ the actual height of the bump as can be seen by comparing dimension A to dimension B.

The control of the position and orientation of the excavation assembly thus includes appropriate control of the lift cylinders 62, the tilt cylinders 64 and the stabilizer cylinders 66. The present invention involves techniques to control the excavation depth, or alternately to control the contour of the new ground surface 182 by coordinated control of these cylinders.

One technique for controlling the position of the excavation assembly 140 is to control the excavation force. The excavation force is comprised of a portion of the weight of the excavation boom 100, that not carried by the base machine, plus the portion of the weight of the base machine transferred to the boom 100 minus the weight borne by the position stabilizer assembly 170. Controlling the pressure applied to the lift cylinders 62 controls the portion of the weight of the base machine transferred to the boom 100, a technique known as Auto-Down pressure. The preferred embodiment of the hydraulic circuit 450 that enables this control technique, in the configuration of Auto-Down for the boom 100, is illustrated in FIG. 4A.

The basic circuit includes a pump assembly 450, comprising pump 402 and control valves, that are capable of providing pressurized hydraulic fluid to a supply line 452 which transfers the fluid to valve 420. Valve 420 is a directional control valve, known as a 3-position valve, illustrated directing the hydraulic fluid to port labeled B, and to line 454 which transfers the pressurized fluid to pressure reducing/relieving valve 410. Valve 420 is controlled to be in this position by energizing solenoid 420B.

The pressure reducing/relieving valve 410 is controlled by valve 456, a poppet valve. If the solenoid of poppet valve 456 is energized, as illustrated in FIG. 4A, it will open a flow path from the pilot end of valve 410 to relief valve 460 through fluid supply line 458. The relief valve will control the fluid pressure in fluid supply line 458, which in turn controls the pressure at which valve 410 effectively operates. Valve 410 effective operates to reduce or relieve the fluid pressure in fluid supply line 462, to a controlled pressure, as set by the adjustment of relief valve 460. The fluid, under controlled pressure, in fluid supply line 462 is transferred to poppet valve 464 and counter balance valve 466. Counter balance valve 466 functions during position control operation, but in the Auto-Down operation is not necessary. Thus, poppet valve 464 effectively bypasses the counterbalance valve 466 by energizing its solenoid at the same time that the solenoid of valve 456 is energized. The two solenoids are simply wired in parallel.

Figure 4A:
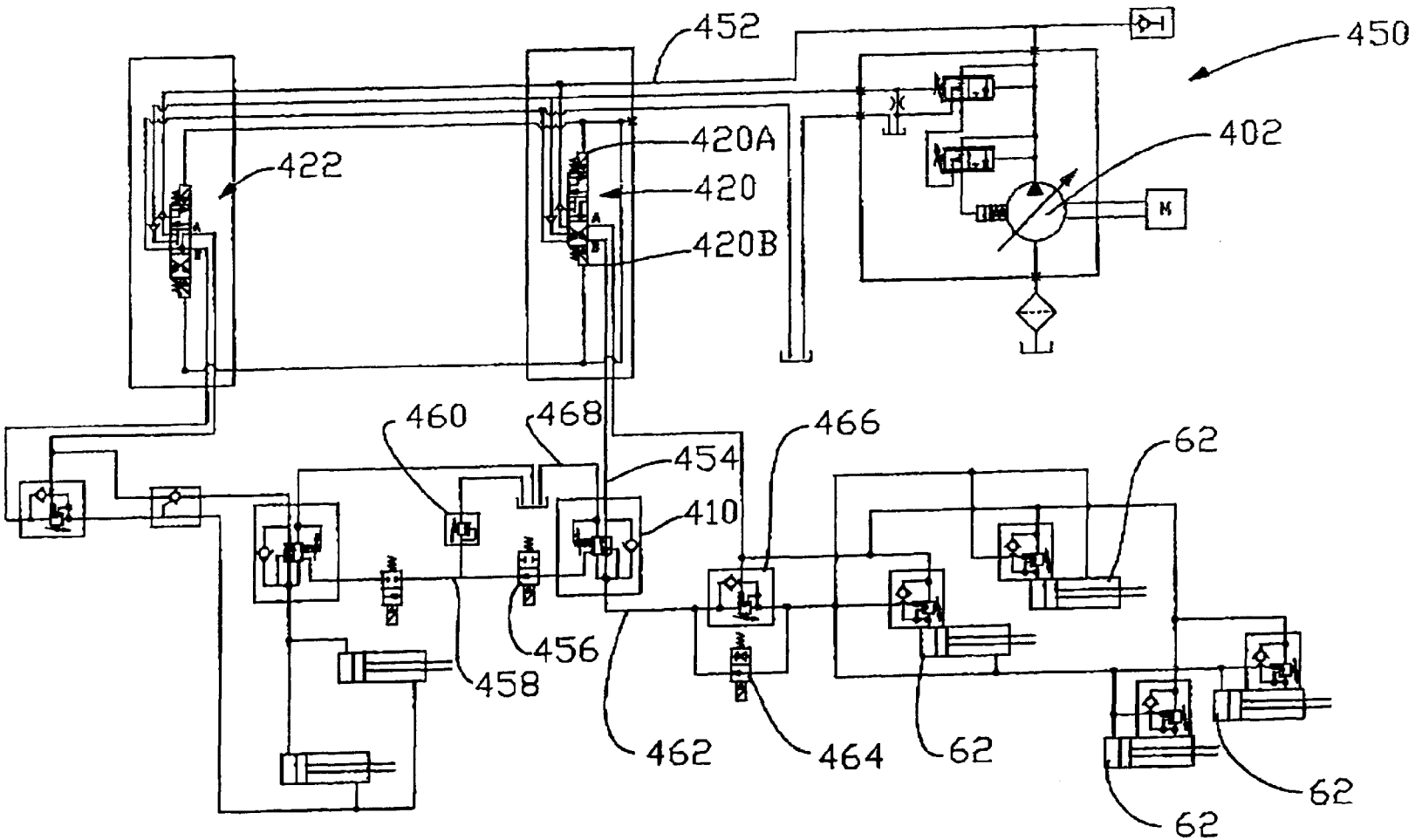
FIG. 4A is a preferred embodiment of the hydraulic schematic illustrating an auto down pressure configuration for the boom.

As illustrated by this hydraulic schematic of FIG. 4A, the hydraulic fluid is transferred from pump 402 to the cylinders 62 in a manner that the cylinders will exert a constant force, attempting to rotate the boom 100 counterclockwise with the machine as illustrated in FIG. 2. Hydraulic fluid will flow from the pump 402 to the cylinders 62 at the reduced pressure set by valve 410, as valve 410 functions as a pressure reducing valve, when the boom 100 rotates counterclockwise. Hydraulic fluid will flow from the cylinders 62 to the tank, as valve 410 functions as a pressure relieving valve, through fluid supply line 468, when the boom 100 is required to rotate clockwise, as when traveling over a surface irregularity. The desired result is that a nearly fixed amount of force, resulting from the transfer of weight from the base machine to the boom 100, is applied to the excavation assembly 140, as the boom 100 is allowed to float to follow the ground surface.

Figure 4B:
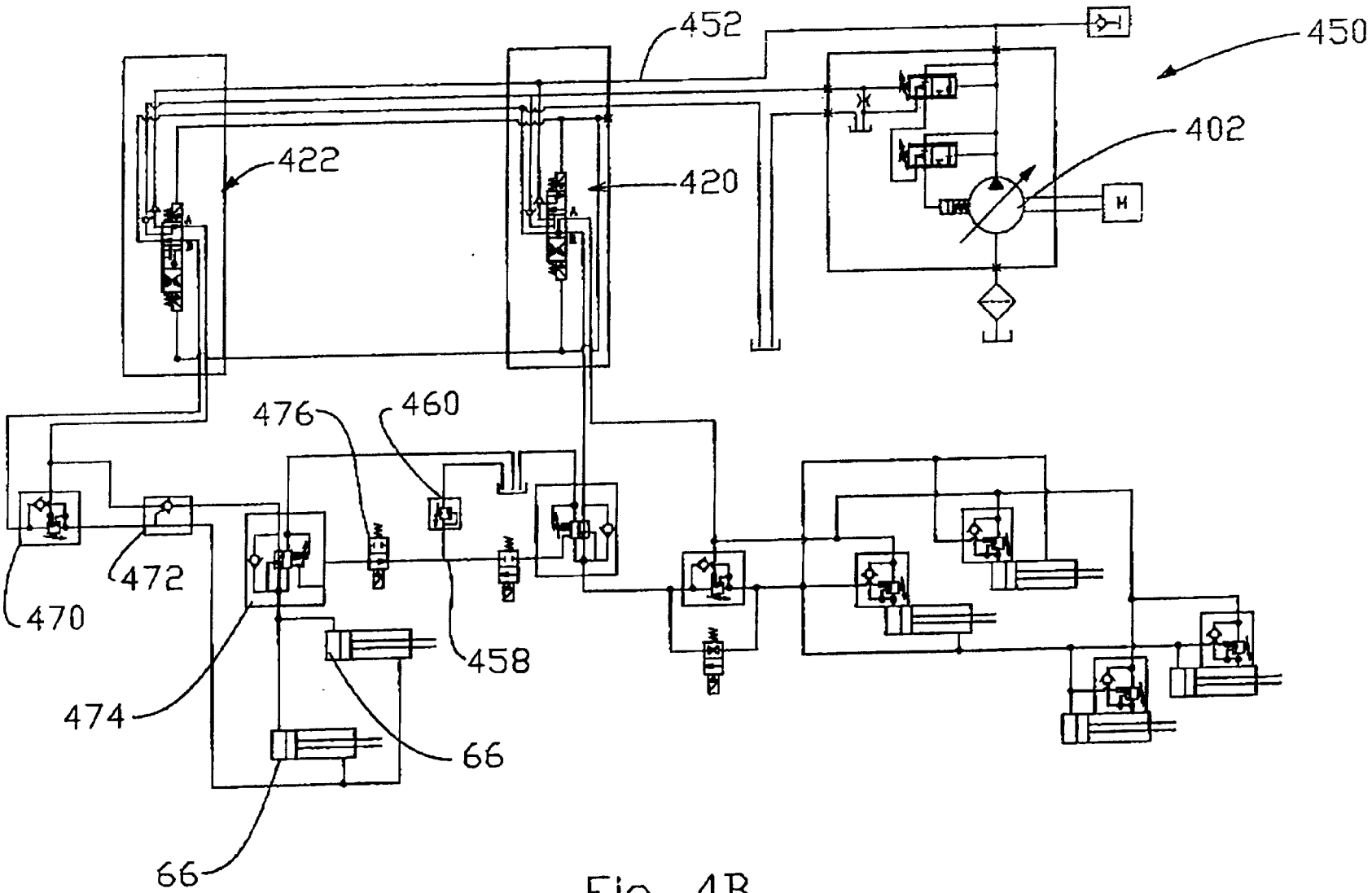
FIG. 4B is the preferred embodiment of the hydraulic schematic illustrating an auto down pressure configuration for the stabilizers.

FIG. 4B illustrates a preferred embodiment of a hydraulic circuit in a configuration that enables a constant down force on the stabilizer assembly 170. This circuit operates in a fashion similar to that described for the boom cylinders 62 as illustrated in FIG. 4A. In the configuration of FIG. 4B, constant down force is applied to the stabilizer assembly 170 by stabilizer cylinders 66. Hydraulic fluid is transferred from the pump 402 to valve 422 through fluid supply line 452. From valve 422 the fluid is transferred through counterbalance valve 470, and pilot operated check valve 472, both with functions unrelated to the auto down pressure. The fluid is then transferred to pressure reducing/relieving valve 474. The pressure reducing/relieving valve 474 is controlled by valve 476 and relief valve 460.

Figure 7:
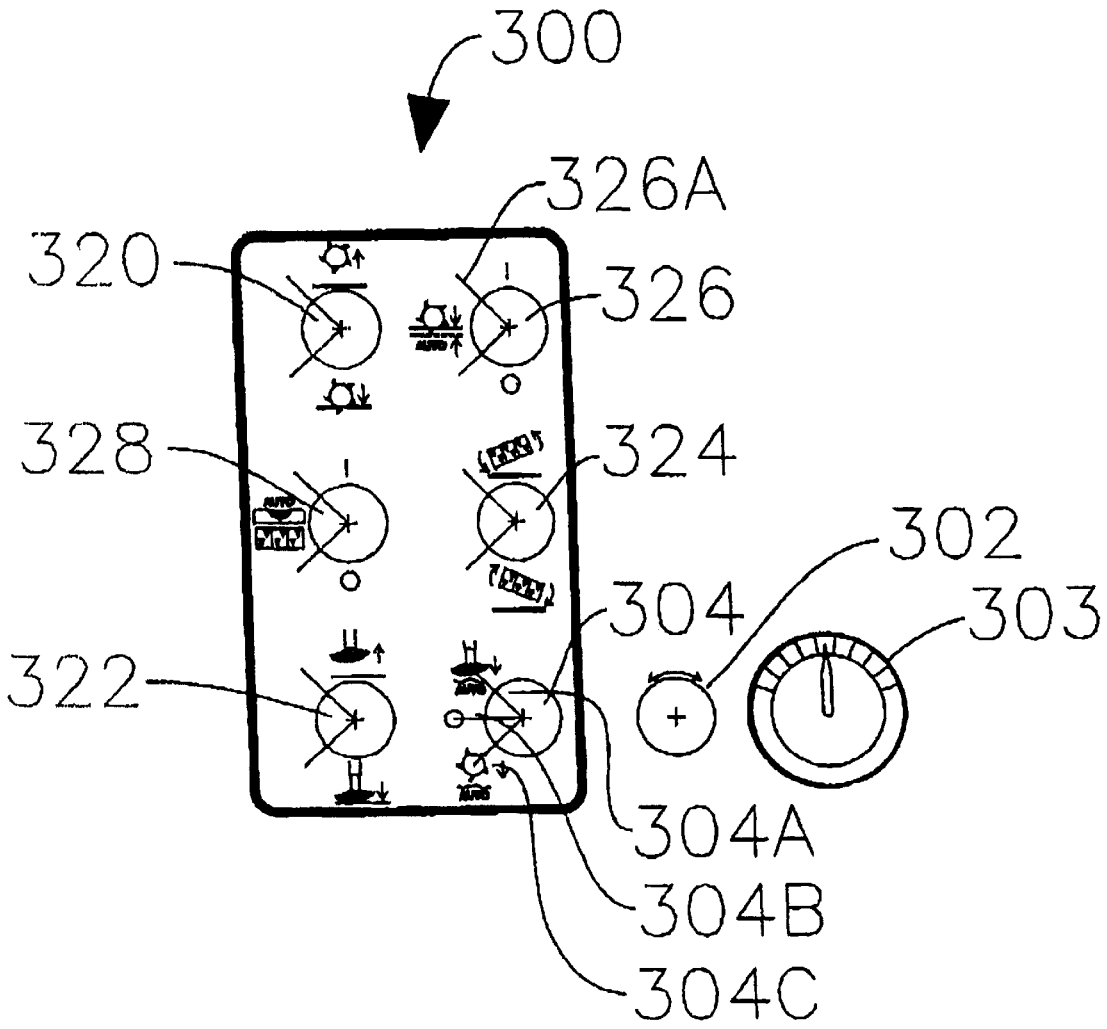
FIG. 7 is a schematic illustration of an operator control panel allowing appropriate selection of auto down pressure, position and pitch control.

As illustrated in FIG. 4B, the solenoid of valve 476 is energized, allowing the pressure in pilot line 458 to effectively control valve 474. Valve 474 functions to reduce the pressure from the pump 402 to a set value and by relieving the pressure, potentially generated by the cylinders 66, to that same pressure. This allows the stabilizer cylinders 66 to move, to follow the topography, while maintaining a consistent force. This force is adjustable by adjusting the pressure in fluid transfer line 458, by adjusting relief valve 460. The pressure is adjustable from the operator's station 300 with adjustment 302, as illustrated in FIG. 7, which effectively adjusts relief valve 460 which is physically located at the control panel. An operator, using pressure gauge 303, can monitor the pressure in fluid transfer line 458.

The operator's station 300 also includes a selector switch 304, with 3 positions 304A, 304B and 304C. In position 304A Auto-Down is selected to control pressure to the boom, which increases the excavation force by transferring additional weight to the boom with lift cylinders 62.

Still referring to FIG. 7, in position 304C Auto-Down is selected for the Stabilizer, to apply a controlled pressure to the stabilizer cylinders 66. The net effect on the excavation force is opposite that described for the auto down pressure for the boom. The controlled pressure is controlling the weight borne by the stabilizer cylinders 66, which reduces the excavation force.

Figure 5:
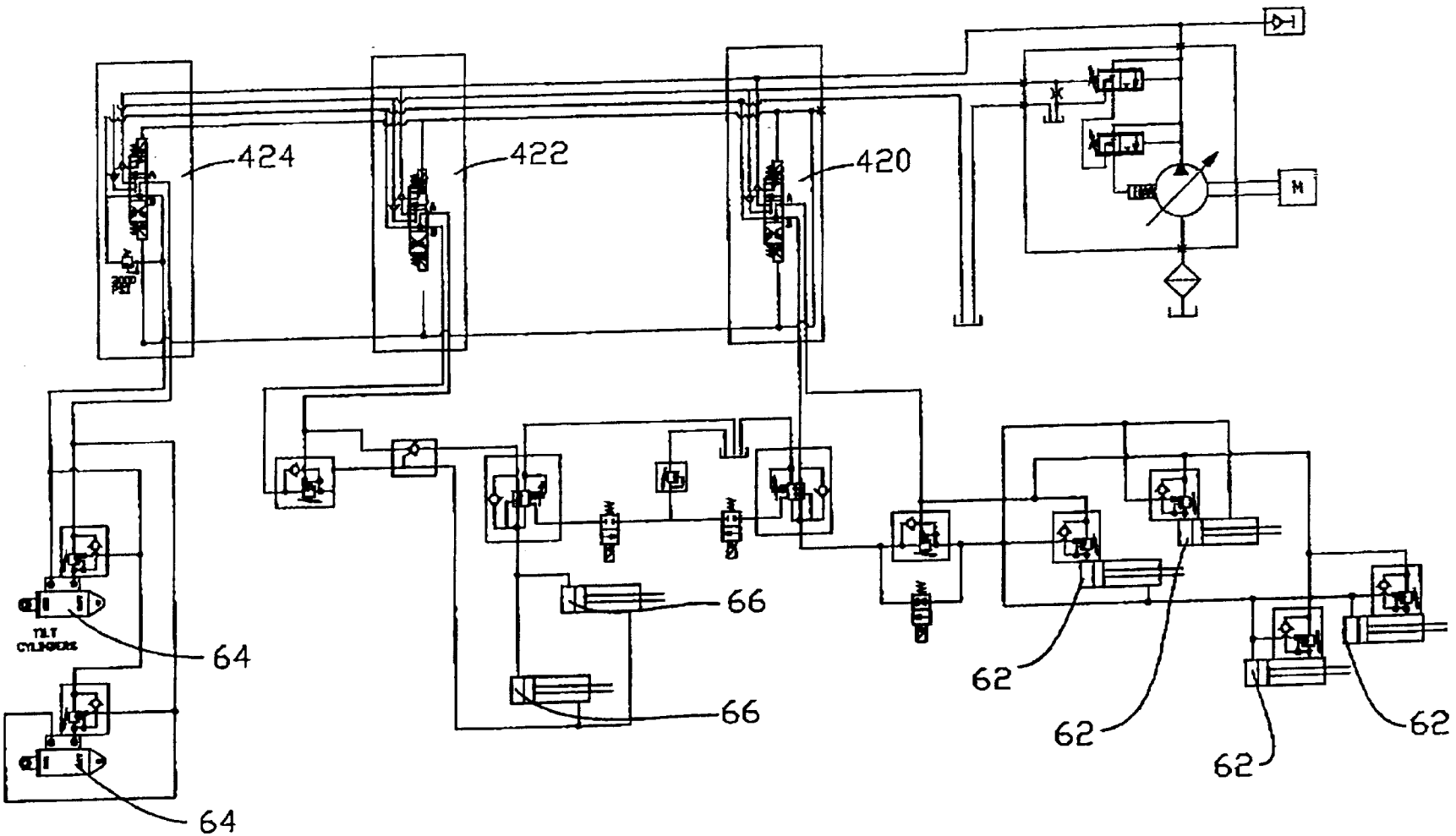
FIG. 5 is the preferred embodiment of a hydraulic schematic illustrating the position control configuration.

Still referring to FIG. 7, in position 304B Auto-Down is turned off, resulting in de-energizing of the solenoids for valves 464, 456 and 476 to effectively disable the pressure reducing/relieving valves 410 and 474. Disabling these valves 464, 456 and 476 will allow the hydraulic circuit to function in a position control mode, as illustrated in FIG. 5.

In some applications control of position/orientation is useful. The operator station 300 of FIG. 7 illustrates two position control options: pitch control and position control. The preferred hydraulic circuit is illustrated in the configuration for position control in FIG. 5 where valve 420 controls position of the boom 100, valve 422 controls position of the stabilizer cylinders 66, and valve 424 controls the tilt cylinders 64. These valves 422 can be controlled manually by switches 320, 322 and 324 as illustrated in FIG. 7, if the valves 422 are actuated by solenoids. Each of the switches 320, 322 and 324 has a first position in which the appropriate cylinder 66 will be extended, a second position in which the appropriate cylinder 66 will be retraced and a third, middle, position in which the cylinders 66 are held in position. They could alternately be controlled mechanically through cables or direct linkage. Many techniques of controlling position control valves are well known, any such technique could be utilized.

Figure 6:
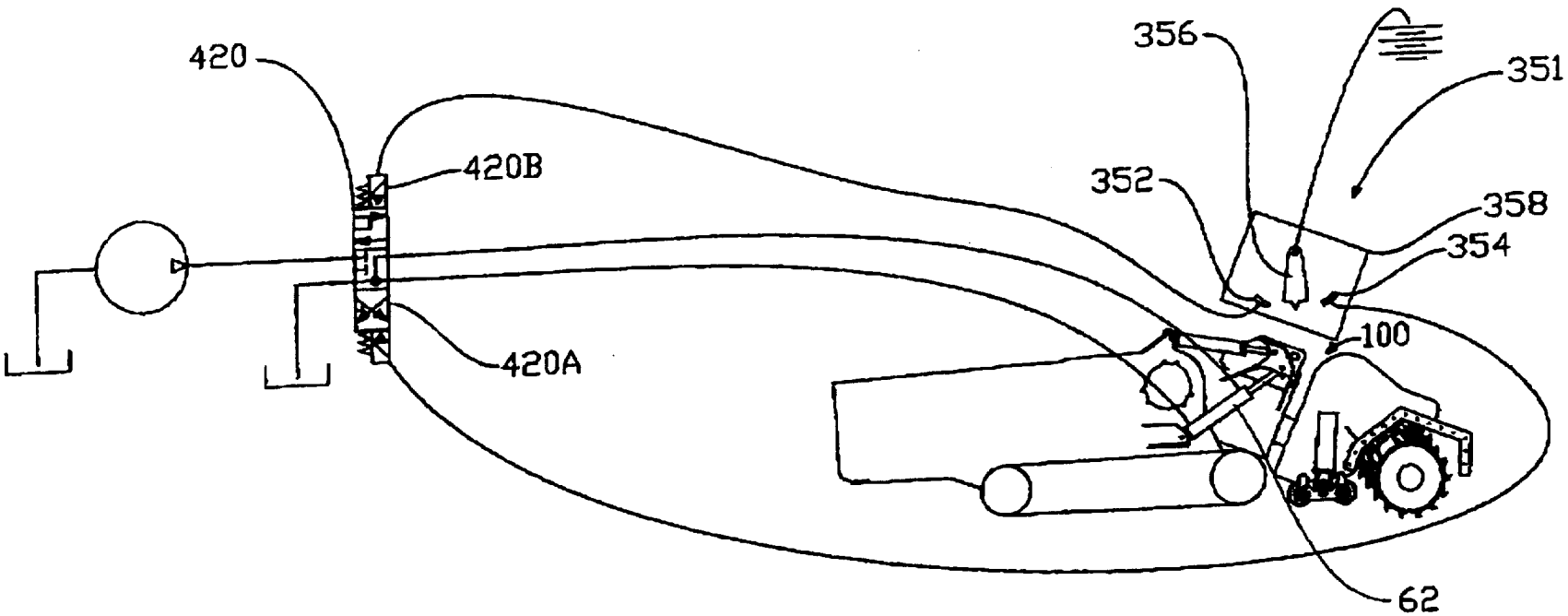
FIG. 6 is the preferred embodiment of a electrical schematic illustrating the pitch control circuit for the boom.

Pitch control is another form of position control, and can be selected from operator station 300 (FIG. 7). Switch 326 allows selection of pitch control of the boom 100, and switch 328 allows selection of pitch control of the tilt cylinders 64. The pitch control is enabled by the preferred embodiment of electrical circuit illustrated in FIG. 6 for the boom 100, comprising a four-way, three-position solenoid valve 420, corresponding to valve 420 illustrated in FIGS. 4A, 4B and 5, and a tilt sensor 351. Tilt sensor 351 includes a center member 356 that freely rotates in housing 358 such that its position is determined by gravity. The tilt sensor 351 is secured to the excavation boom 100, as illustrated in FIG. 2, contains two sensor pads 352 and 354. When the housing is tilted clockwise, indicating the boom 100 has rotated clockwise, the center member 356 will contact pad 354. This will result in energizing solenoid 420B which will shift valve 420 into a position to direct oil to rotate the excavation boom 100 counterclockwise. Many types of tilt sensors are commercially available including those wherein there is no physical contact, wherein there are magnetic reed switches and the center member includes a magnet that causes the reed switches to close when in close proximity. The type of switch is not important.

Solenoid 420B will remain energized until the boom 100 has rotated counterclockwise far enough such that the center member 356 of tilt sensor 350 is no longer contacting pad 354. The system operates in a similar manner if the boom 100 is positioned too far counter clockwise wherein pad 352 is contacted, solenoid 420A is energized resulting in the boom moving clockwise.

A similar electrical circuit will enable pitch control for the tilt cylinders 64 with a tilt sensor 350 installed to detect the orientation of the head unit 130 (as illustrated in FIG. 2) and is enabled by switch 328.

Operation

In operation, the auto-down control is given precedence. For instance, referring to FIG. 7, the operator can select auto-down pressure for the boom 100, by positioning switch 304 in position 304C, and at the same time select pitch control for the boom 100, by positioning switch 326 in position 326A. In this scenario, the auto-down pressure overrides, and the tilt sensor is ignored.

This precedent relationship can be defined by appropriate wiring techniques, or could alternately be defined using a programmable logic controller of any known type.

The purpose of the auto-down control has previously been described in the description of the hydraulic circuits: to provide a consistent force to either the boom, to increase the excavation force, or to the stabilizer cylinders 66 to effectively reduce the excavation force. A preferred operating configuration is to have the auto-down control activated for the boom while the stabilizer cylinders 66 are set at a given position. This provides consistent load on the excavating assembly 140 while providing depth control with the position of the stabilizer cylinders 66.

Referring again to FIG. 7, the pitch control (switch 328) for the tilt provides a mechanism to hold the tilt of excavation assembly 140 constant to provide a new ground surface 182 of a consistent pitch or grade. The purpose of the pitch control of the boom 100, using switch 328, is to provide a new ground surface 182 that is smoother than the existing ground surface 180.

Figure 9A:
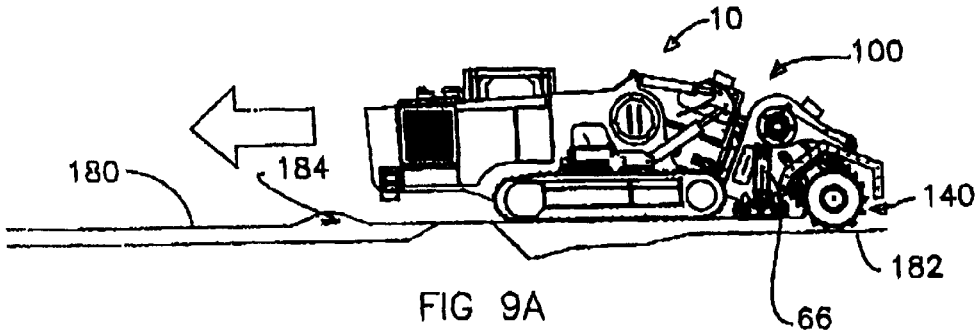
FIGS. 9A, 9B and 9C are sequential side views that illustrate a trencher traveling along an existing ground surface that includes a bump.
Figure 9B:
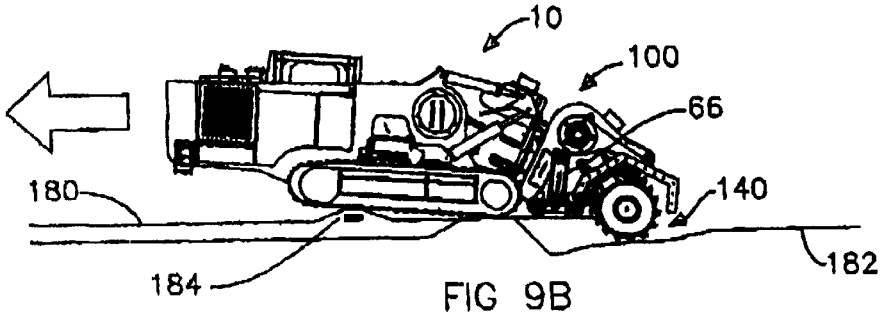
Figure 9C:
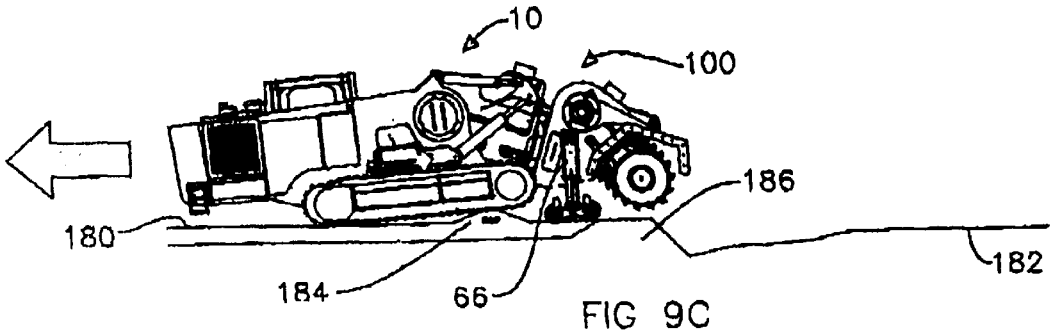

This is illustrated in FIGS. 9A, 9B, 9C, 10A, 10B and 10C. FIGS. 9A, 9B and 9C illustrate trencher 10 traveling along an existing ground surface 180 that includes a bump 184. In these figures, the excavation boom 100 is position controlled and its orientation relative to the base machine is fixed, while the stabilizer cylinders 66 are controlled for auto-down pressure.

As illustrated in FIG. 9B, the tracks will initially climb the bump 184, causing the excavation assembly 140 to be lowered. The machine will continue to travel along the ground and, as illustrated in FIG. 9C, the bump 184 will eventually be under the opposite end of the tracks. In this position the excavation assembly would be raised, to the point it will not even contact the ground. The net effect is that the new ground plane 184 will contain a bump 186 that is larger than the original bump 184 as illustrated in FIG. 9C.

Figure 10A:
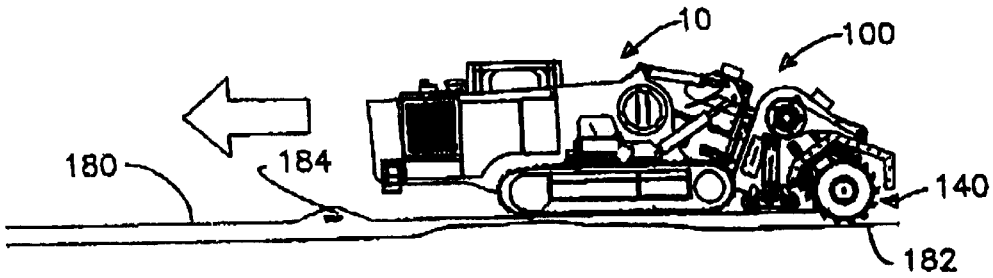
FIGS. 10A, 10B and 10C are sequential side views that illustrate a trencher traveling along an existing ground surface that includes a bump like FIGS. 9A, 9B and 9C but with the boom set to pitch control using the present invention.
Figure 10B:
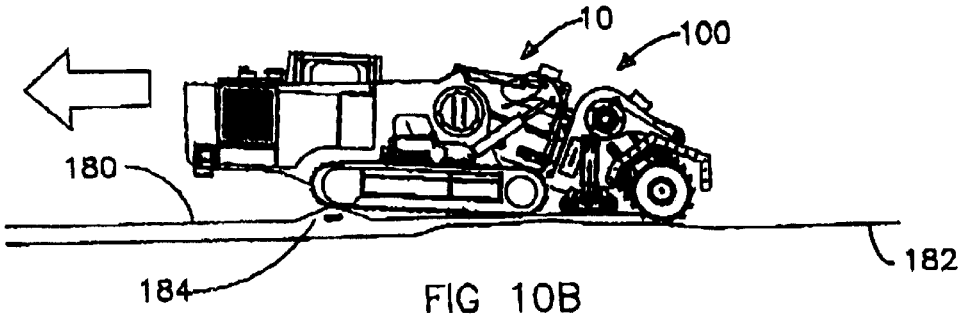
Figure 10C:
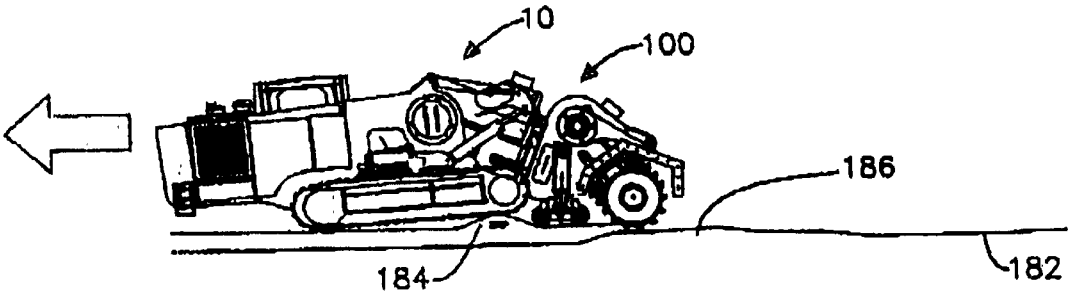

FIGS. 10A, 10B and 10C illustrate the same base trencher of FIGS. 9A, 9B and 9C traveling over the same bump 184, but this time with the boom 100 set, using switch 238, to pitch control. Using the pitch control, the boom 100 is controlled such that its engagement with the ground is improved, and the bump 186 in the new ground surface 184 is less defined than the original bump 184. In this manner the surface is improved. FIG. 10A looks essentially like FIG. 9A. However, in FIG. 10B it can be seen that the pitch control has pivoted the boom 100 upwardly compared to the boom 100 shown in FIG. 9B so that the bump 186 is reduced in FIG. 10B compared to bump 186 in FIG. 9B. In FIG. 10C, the boom 100 is now lowered with respect to the surface 180 compared to the boom 100 in FIG. 9C so that it can better remove bump 184.

Figure 8:
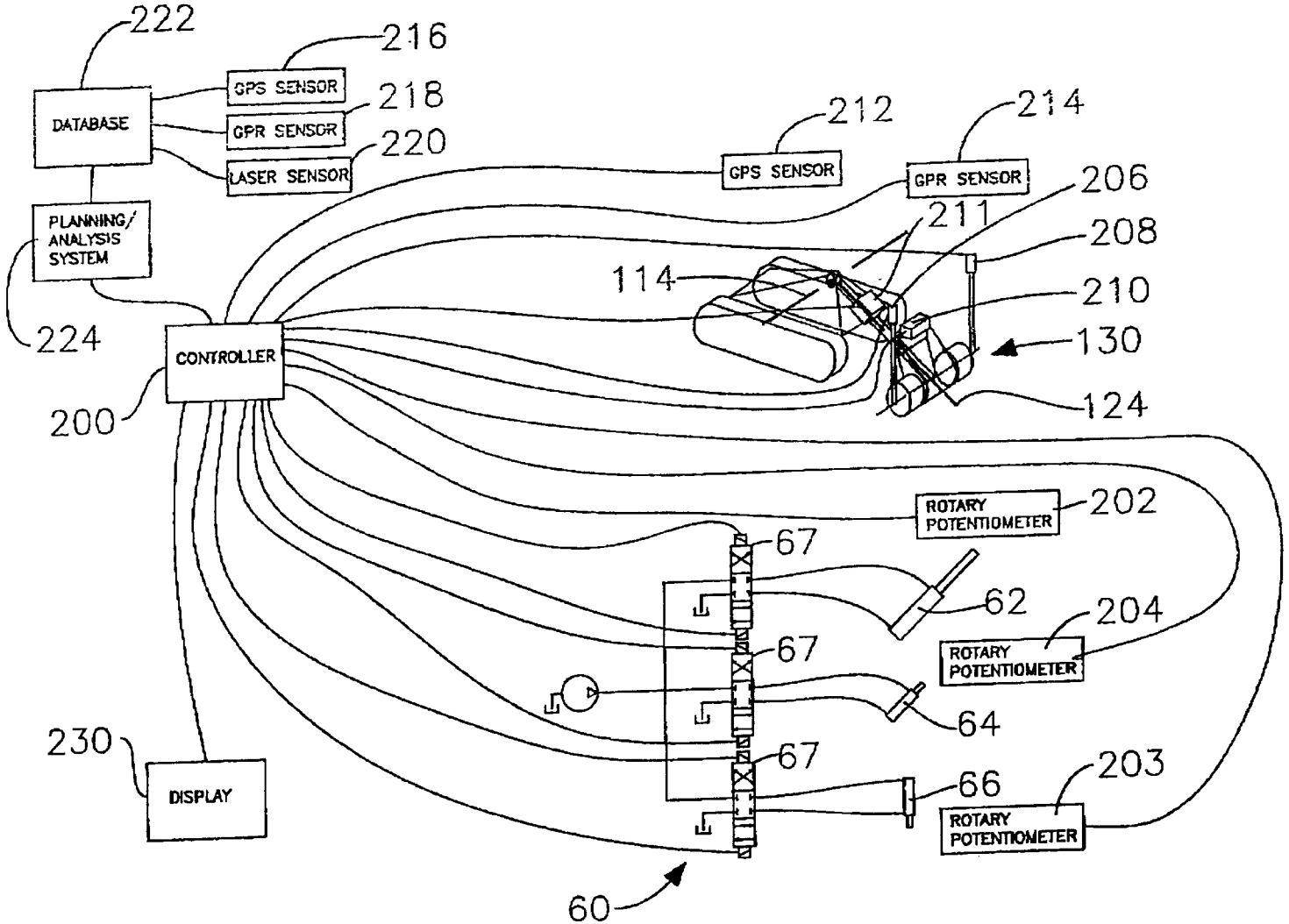
FIG. 8 is a schematic of an alternate embodiment of a control system.

FIG. 8 illustrates several alternative embodiments of a control system of the present invention that would provide increased capability. A hydraulic control system 60 includes lift cylinder(s) 62, tilt cylinder(s) 64 and stabilizer cylinder (s) 66 in addition to control valves 67.

A controller 200 is capable of accepting inputs and controlling outputs to control various mechanical elements of the trencher. The control system would be capable of controlling many systems other than illustrated in this Fig, including the drive motor to the tracks 24 and excavation boom hydraulic motor 52 as disclosed in U.S. Pat. Nos. 5,590,041; 5,574,642; 5,509,220 which are all incorporated herein by reference. For the purpose of explaining the current invention, the control aspects related to positioning the excavating boom are included in FIG. 8. The primary outputs required for this control are the outputs for controlling valves 67 and display 230. Inputs could include:

1) an indication of the relative position of the head unit 130 as tilted on axis 124, which can be indicated with a rotary potentiometer 202;
2) an indication of the relative position of the mount section 110 as tilted on axis 114, an indication of cutting depth, which can be indicated with a rotary potentiometer 204;
3) an indication of the position of the stabilizers as indicated with a rotary potentiometer 203;
4) An indication of the relative height of the right side of the excavating drum 148R, which can be indicated with a laser target 206;
5) An indication of the relative height of the left side of the excavating drum 148L, which can be indicated with a laser target 208;
6) An indication of the pitch of the new ground surface 172, which can be indicated by a tilt sensor 210 mounted on the head unit 130 of the excavating boom assembly 100;
7) An indication of the depth of cut which can be indicated by a tilt sensor 211 mounted in fixed relationship to axis 124;
8) An indication of the position of the excavating boom assembly 100 which can be indicated by a Global Position Sensor 212 mounted onto the head unit 130;
9) An indication of the sub-surface conditions can be determined by a GPR unit 214 or other sensors. Techniques of performing these types of subsurface surveys are disclosed in U.S. Pat. Nos. 6,195,922; 6,119,376; 5,704,142; 5,659,985; 5,553,407 and pending application Ser. No. 60/211,431 all of which are hereby incorporated by reference. Mounting the sensors onto the track trencher in an appropriate location will provide the capability to do real-time monitoring and control of the excavating process.
10) An alternate and preferable technique is be to mount a GPS sensor 216, subsurface sensors like a GPR 218 or any other such sensor, possibly a relative height sensor as in a laser target 220 onto a separate cart and perform preliminary surveys. The information generated by the preliminary surveys could be contained in a database 222, post processed by a planning/analysis system 224 wherein the 3-D contour of the desirable geology is identified. The contours can be evaluated and an optimized excavation route determined optimizing production rates, minimizing travel/turn requirements, minimizing any non-productive activity required, etc. The resulting excavation plan can then be insert into the controller 200 where it may be used to provide a control signal to an operator via display 230, or alternatively to control the excavator directly.

With this or similar arrangements of components the excavation process can be controlled in a variety of manners to achieve various results.

If a subsurface survey is completed and a map/plan developed, the inputs which allow determination of the depth of the excavation, the rotary pots 204 and 202 and height sensors 206 and 208, can be used to control the excavator to excavate to a certain depth while also maintaining control to a set depth of cut. The inputs can be used to control both in a manner to optimize the excavation process.

Likewise if the subsurface survey is completed in real-time, the ultimate depth of the excavation, the location of the new ground surface 182, can be determined in a manner to optimize both the location of that surface and the depth of cut.

The result of the various embodiments is an excavation machine that provides a variety of control modes allowing the operator to select the mode best suited for the conditions. The embodiments range from basic switches with no controller, to the most complex system comprising a controller and the ability to incorporate logic.

A primary consideration in this excavation process is the quality of the excavated material. The previously described control systems provide a means of varying operation and control associated with depth of cut to affect the quality of this final product. Additionally the depth of cut can be utilized in conjunction with controlling the ground speed of the excavator to optimize the quality of the resulting product. It has been found that operating the machine in a mode of relatively high ground speed, with relatively shallow excavation depth yields the best quality of product and the highest productivity, for certain materials. With the control systems of the present invention the operation of the excavation machine can be controlled to achieve the desired result.

Obviously many modifications and variations of the present invention are possible in light of the above teachings. It is therefore to be understood that, within the scope of the appended claims, the invention may be practiced otherwise than as specifically described.

We claim:

1. A method of controlling an excavator including a frame, engine, ground supports and an excavation boom with an excavating drum that includes a stabilizer that operably engages the ground independently of the excavation boom, a boom position actuator and a stabilizer actuator, the method comprising:

setting a position of the excavating boom by controlling the position of either the boom position actuator or the stabilizer actuator connected operably to the boom; and controlling a downward force exerted by the other actuator.

2. The method of claim 1 wherein the step of setting the position of the excavating boom comprises fixing a position of the boom relative to the frame and using ground supports to define an excavation depth.

3. The method of claim 1 wherein the step of setting a position of the excavating boom comprises fixing an orientation of the boom relative to gravity to approximately control the shape of an excavated ground plane.

4. The method of claim 3 wherein the step of controlling the downward force exerted by the stabilizer includes applying an upward force from the ground plane to the boom when the frame tips upwardly on a forward end thereof due to encountering a bump in the ground plane.

5. The method of claim 3 wherein the step of controlling the downward force exerted by the stabilizer includes pivoting the boom upwardly with hydraulic cylinders attached to the frame when the frame tips upwardly on a forward end thereof due to encountering a bump in the ground plane.

6. A method of controlling an excavator including a frame, engine, ground supports, an excavation boom with an excavating drum, and a level sensor sensing an orientation of the excavation boom, the excavation boom mounted to a boom supporting arm that is pivotally mounted onto the frame such that variations in the angular orientation of the boom supporting arm relative to the frame affect the location of the excavating drum relative to the ground supports, the method comprising fixing the orientation of the boom supporting arm relative to gravity by automatically controlling the angular orientation of the boom supporting arm relative to the frame based on a signal from the level sensor to approximately control the shape of an excavated ground plane as measured along a line parallel to the direction of travel of the excavator.

7. The improved excavator of claim 6 wherein the excavating boom has the excavating drum operatively attached thereto.

8. An improved excavator comprising:

a frame;

engine operatively attached to the frame;

ground supports operatively attached to the frame;

an excavation boom operatively attached to the frame;

an excavating drum operatively attached to the frame;

a stabilizer operatively attached to the frame and boom that operably engages the ground independently of the excavation boom;

a boom position actuator operatively attached to the frame and boom;

a stabilizer actuator operatively attached to the frame and stabilizer;

means for setting a desired position of the excavating boom comprising means for setting the position of either the boom position actuator or the stabilizer actuator operably to the boom; and means for controlling a downward force exerted by the other actuator.

9. The apparatus of claim 8 wherein the means setting a desired position of the excavating boom comprises means for fixing the desired position of the boom relative to the frame and means for using ground supports to define an excavation depth.

10. The apparatus of claim 8 wherein the means for setting a position of the excavating boom comprises means for fixing an orientation of the boom relative to gravity to approximately control the shape of an excavated ground plane.

11. The of claim 10 wherein the means for controlling the downward force exerted by the stabilizer includes means for applying an upward force from the ground plane to the boom when the frame tips upwardly on a forward end thereof due to encountering a bump in the ground plane.

12. The apparatus of claim 10 wherein the means for controlling the downward force exerted by the stabilizer includes means for pivoting the boom upwardly with hydraulic cylinders attached to the frame when the frame tips upwardly on a forward end thereof due to encountering a bump in the ground plane.

13. An improved excavator comprising:

a frame;

engine operatively attached to the frame;

ground supports operatively attached to the frame;

an excavation boom with an excavating drum, the excavation boom mounted to a boom supporting arm that is pivotally mounted onto the frame such that variations in the angular orientation of the boom supporting arm relative to the frame affect the location of the excavating drum relative to the ground supports operatively attached to the frame;

a level sensor sensing an orientation of the excavation boom; and means for fixing the orientation of the boom supporting arm relative to gravity by automatically controlling the angular orientation of the boom supporting arm relative to the frame based on a signal from said level sensor to approximately control the shape of an excavated ground plane as measured along a line parallel to the direction of travel of the excavator.

14. The improved excavator of claim 13 wherein the excavating boom has the excavating drum operatively attached thereto.

* * * * *